US008502451B2

(12) United States Patent
Chiba

(10) Patent No.: US 8,502,451 B2
(45) Date of Patent: Aug. 6, 2013

(54) COLLECTOR AND ELECTRON TUBE

(75) Inventor: Akira Chiba, Kanagawa (JP)

(73) Assignee: Netcomsec Co. Ltd., Tokyo (JP)

( * ) Notice: Subject to any disclaimer, the term of this patent is extended or adjusted under 35 U.S.C. 154(b) by 612 days.

(21) Appl. No.: 12/724,529

(22) Filed: Mar. 16, 2010

(65) Prior Publication Data

US 2010/0244690 A1 Sep. 30, 2010

(51) Int. Cl.
*H01J 23/02* (2006.01)

(52) U.S. Cl.
USPC ..... 315/5.38; 315/3.5; 315/5.11; 315/39.63; 315/495; 250/310; 445/58

(58) Field of Classification Search
USPC ..... 315/3.5, 5.38, 5.42, 5.11–5.13, 39.3, 315/39.63, 500; 313/309, 495, 497; 250/283, 250/289, 310; 445/51, 58; 219/603, 615
See application file for complete search history.

(56) References Cited

U.S. PATENT DOCUMENTS

| | | | | |
|---|---|---|---|---|
| 6,653,787 | B2 * | 11/2003 | Watkins et al. | 315/5.38 |
| 6,700,454 | B2 * | 3/2004 | Yaniv et al. | 333/1 |
| 7,196,464 | B2 * | 3/2007 | Chen et al. | 313/497 |
| 7,339,167 | B2 * | 3/2008 | Ohshima et al. | 250/310 |
| 7,374,730 | B2 * | 5/2008 | Simard et al. | 422/186 |
| 7,388,201 | B2 * | 6/2008 | Cholewa et al. | 250/310 |

FOREIGN PATENT DOCUMENTS

JP 11-67108 A 3/1999

OTHER PUBLICATIONS

L.Huang et al., "Local Measurement of Secondary Electron Emission from ZnO-coated Carbon", Nanotechnology 17 (2006) pp. 1564-1567.

* cited by examiner

*Primary Examiner* — Haiss Philogene

(57) ABSTRACT

A collector included in an electron tube is covered with a carbon nanotube layer over a required area on the surface thereof.

3 Claims, 3 Drawing Sheets

COLLECTOR AND ELECTRON TUBE

This application is based upon and claims the benefit of priority from Japanese Patent Application No. 2009-074014, filed on Mar. 25, 2009.

TECHNICAL FIELD

The present invention relates to a collector for capturing electron beams emitted from an electron gun, and an electron tube which comprises the same

BACKGROUND ART

A traveling wave tube, a klystron and the like are electron tubes which are used for performing amplification, oscillation and the like of an RF (Radio Frequency) signal through interactions of electron beams emitted from an electron gun with a high frequency circuit.

As shown in FIG. 1, traveling wave tube 1 comprises, for example, electron gun 10 for emitting electron beam 50, helix 20 which is a high frequency circuit for causing electron beam 50 emitted from electron gun 10 to interact with an RF signal, a collector 30 for capturing an electron beam 50 emitted from electron gun 10, and anode 40 for drawing electrons from electron gun 10 and guiding electron beam 50 emitted from electron gun 10 into spiral helix 20. Electron gun 10 comprises cathode 11 for emitting hot electrons, and heater 12 for giving thermal energy to cathode 11 for causing the same to emit hot electrons.

Electron beam 50 emitted from electron gun 10 is accelerated by a potential difference between cathode 11 and anode 40, and introduced into helix 20, and then travels within helix 20 while interacting with an RF signal input from one end of helix 20. Electron beam 50 which has passed through the inside of helix 20 is captured by collector 30. In this event, the RF signal is amplified by the interaction with electron beam 50, and output from the other end of helix 20.

Power supply device 60 supplies cathode 11 with a helix voltage (Ehel) which is a negative DC voltage with reference to the potential (HELIX) of helix 20. Power supply device 60 also supplies collector 30 with a collector voltage (Ecol) which is a positive DC voltage with reference to the potential (H/K) of cathode 11, and supplies heater 12 with heater voltage (Eh) which is a negative DC voltage with reference to the potential (H/K) of cathode 11. Helix 20 is generally connected to the case of traveling wave tube 1 for grounding.

Notably, while FIG. 1 shows an exemplary configuration of traveling wave tube 1 which comprises one collector 30, traveling wave tube 1 may comprise a plurality of collectors 30. Also, while FIG. 1 shows an exemplary use in which anode 40 is grounded within power supply device 60, there is also another exemplary use for traveling wave tube 1, in which anode 40 is supplied with anode voltage (Ea) which is a positive DC voltage with reference to the potential (H/K) of cathode 11.

FIGS. 2 and 3 show a detailed exemplary configuration of collector 30 shown in FIG. 1. Collectors 30 shown in FIGS. 2 and 3 are also described, for example, in Background Art of Japanese Laid-Open Patent Application No. 11-67108.

FIG. 2 is a side sectional view showing an exemplary configuration of a background art collector, and FIG. 3 is a side sectional view showing another exemplary configuration of a background art collector. FIG. 2 shows an exemplary configuration of a traveling wave tube which comprises one collector, while FIG. 3 shows an exemplary configuration of a traveling wave tube which comprises two collectors.

The traveling wave tube shown in FIG. 2 comprises closed cylindrical collector 30, where the size of collector 30 is gradually reduced in a tapering shape from the middle of the side surface toward an open end. Collector 30 is supported and fixed within an enclosure 33 of traveling wave tube 1 by insulating ceramic 32 such that the opening is oriented to electron gun 10 (see FIG. 1). Lead wire 34 is connected to the bottom of collector 30, and this lead wire 34 is drawn to the outside through collector terminal 35 disposed on enclosure 33.

On the other hand, the traveling wave tube shown in FIG. 3 comprises first cylindrical collector $\mathbf{30}_1$ and second closed cylindrical collector $\mathbf{30}_2$. The size of first collector $\mathbf{30}_1$ is gradually reduced in a tapering shape from the middle of the side surface toward one open end. Second collector $\mathbf{30}_2$ has a shape similar to that of collector 30 shown in FIG. 2.

First collector $\mathbf{30}_1$ and second collector $\mathbf{30}_2$ are supported and fixed within enclosure 33 of traveling wave tube 1 by insulating ceramic 32 such that their respective openings are oriented to electron gun 10 (see FIG. 1). First lead wire $\mathbf{34}_1$ is connected to first collector $\mathbf{30}_1$, while second lead wire $\mathbf{34}_2$ is connected to second collector $\mathbf{30}_2$.

First lead wire $\mathbf{34}_1$ is drawn to the outside through a gap defined in insulating ceramic 32 and first collector terminal $\mathbf{35}_1$ disposed on enclosure 33. Second lead wire $\mathbf{34}_2$ in turn is drawn to the outside through second collector terminal $\mathbf{35}_2$ disposed on enclosure 33.

Collector 30 shown in FIG. 2, and first collector $\mathbf{30}_1$ and second collector $\mathbf{30}_2$ shown in FIG. 3 are made of molybdenum (Mo), copper (Cu) or a composite material comprised of molybdenum and copper, and are worked into the shapes shown in FIGS. 2 and 3 by cutting plate materials or bar stocks made of these materials.

Also, collector 30 shown in FIG. 2, and first collector $\mathbf{30}_1$ and second collector $\mathbf{30}_2$ shown in FIG. 3 are formed, for example, with a copper plated layer having a secondary electron emission coefficient smaller than that of molybdenum, or a graphite layer having a secondary electron emission coefficient smaller yet than that of copper on the entire surface or part of the surface in order to restrain emission of secondary electrons due to collisions of electron beams.

Generally, it is difficult to plate copper on the surface of the collector made of molybdenum, described above, and even if the plated layer is formed, the layer has a problem in that it can be easily peeled off. This is attributable to the low bonding force of the copper plated layer with molybdenum because molybdenum does not form a stable compound with copper.

On the other hand, Graphite is a layered compound. In each layer, the carbon atoms are arranged in a hexagonal lattice. While the Carbon-Carbon bond within the plane exhibits a high bonding force due to the $sp^2$ hybrids, planes positioned one on another exhibit a low bonding force because they are bonded with the van der Waals forces. Also, graphite includes many lattice defects in end regions, where carbon atoms are not bonded to one another, giving rise to a problem in which graphite is easily dissociated by carbon atoms in the lattice defect parts which bond with oxygen atoms, hydrogen atoms and the like. For this reason, a graphite plane might be peel off, if it is heated in a brazing operation or the like during the assembly process of a traveling wave tube. In particular, graphite is formed by dense layers, and if the base metal is copper, there is a high possibility that graphite will peel off due to the difference in the thermal expansion coefficient when it is heated.

SUMMARY

It is therefore an object of the present invention to provide a collector which comprises a surface layer that is hard to peel off, and an electron tube which comprises this collector. In an aspect of the present invention for achieving the above-described object, a collector of the present invention is a collector included in an electron tube, which comprises a carbon nanotube layer formed over a required area on the surface thereof.

On the other hand, an electron tube of the present invention comprises the above collector.

The above and other objects, features, and advantages of the present invention will become apparent from the following description with reference to the accompanying drawings, which illustrate examples of the present invention.

EXEMPLARY EMBODIMENT

Next, the present invention will be described with reference to the drawings. While the following description will be given in connection with a collector included in a traveling wave tube, by way of example, the present invention can be applied to collectors in other electron tubes.

Figure 4:
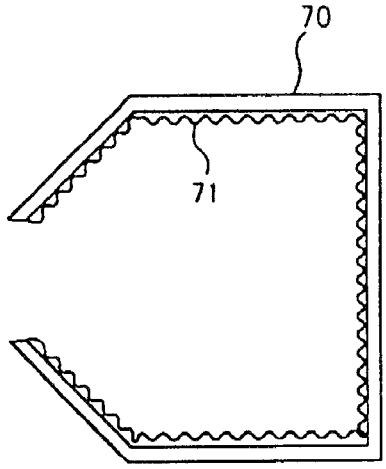
FIG. 4 is a side sectional view showing an exemplary configuration of a collector according to the present invention.

FIG. 4 is a side sectional view showing an exemplary configuration of a collector of the present invention.

As shown in FIG. 4, collector 70 of this embodiment comprises carbon nanotube layer 71 formed over a required area on the surface of collector 70 which is made of molybdenum (Mo), copper (Cu), or a composite material comprised of molybdenum and copper.

Figure 1:
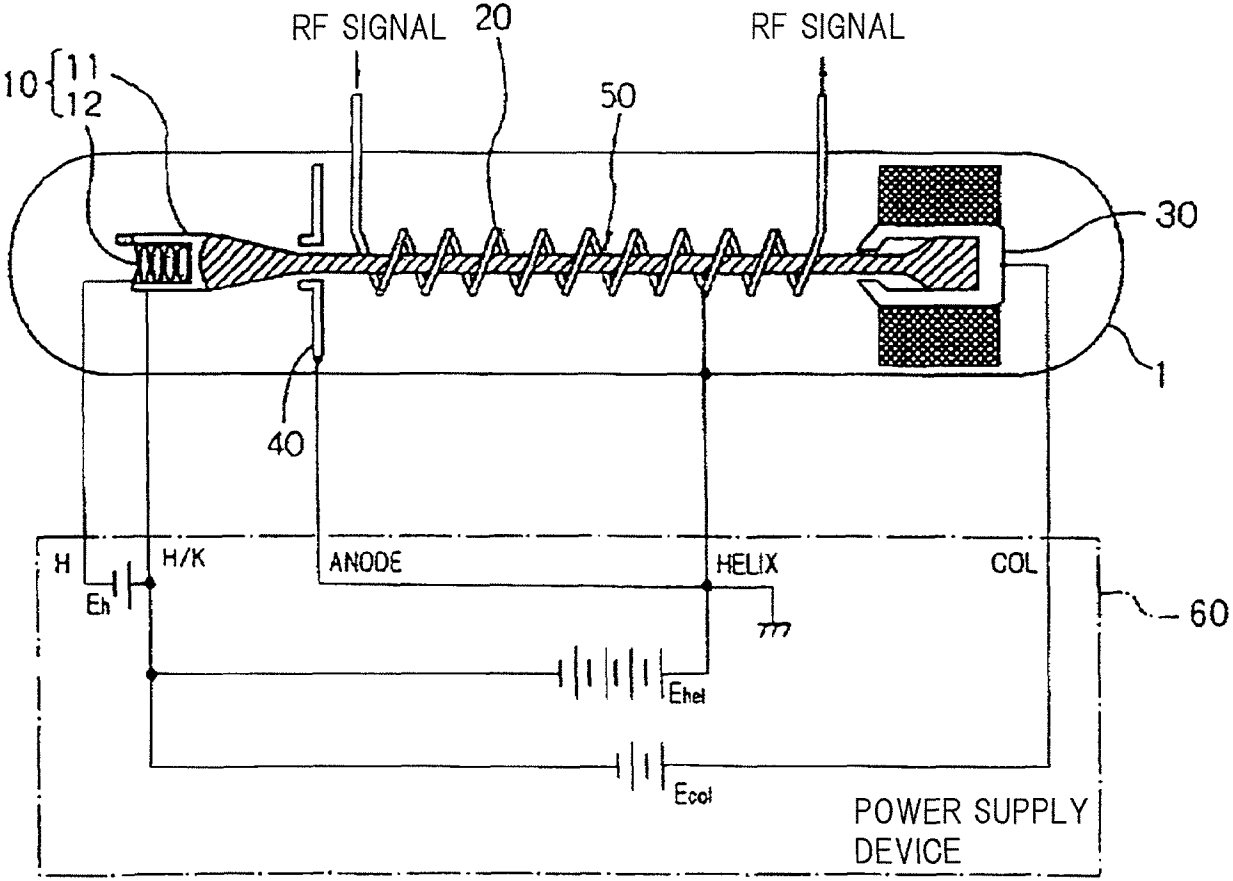
Fig. 1 RELATED ART
FIG. 1 is a block diagram showing an exemplary configuration of a high frequency circuit system which includes an electron tube and a power supply device.
Figure 2:
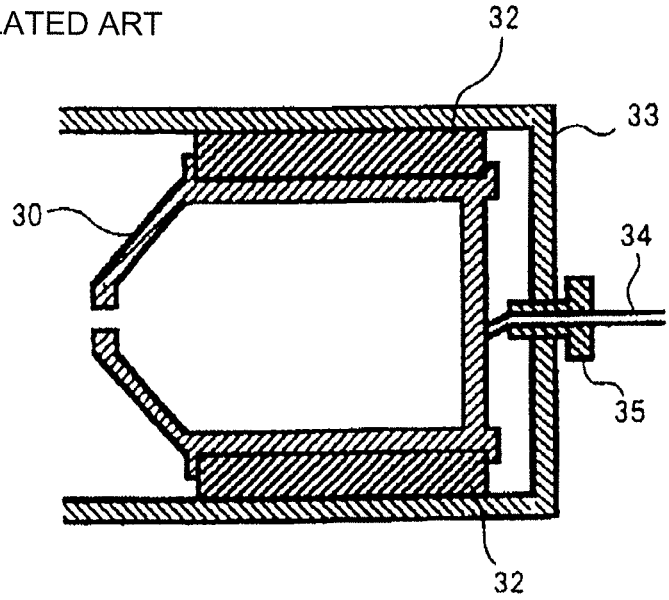
Fig.2 RELATED ART
FIG. 2 is a side sectional view showing an exemplary configuration of a background art collector.

As indicated by an area with a wavy line in FIG. 4, carbon nanotube layer 71 is formed to cover an entire area for capturing electron beams emitted from an electron gun (see FIG. 1). Specifically, carbon nanotube layer 71 is formed on the entirety of the inner surface of collector 70.

Figure 3:
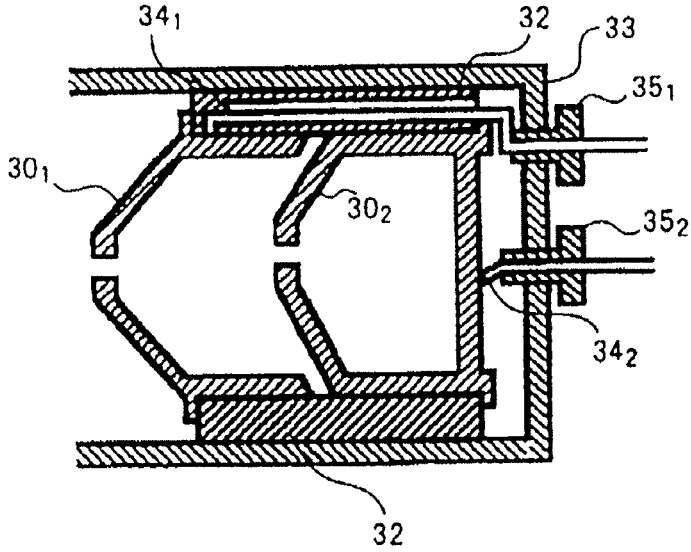
FIG. 3 is a side sectional view showing another exemplary configuration of a background art collector.

In this regard, FIG. 4 shows an exemplary shape of collector 70 when a traveling wave tube is configured to comprise one collector. In a traveling wave tube comprising two or more collectors, the collector furthest away from a helix (see FIG. 1) has a similar shape to that of FIG. 4, while the remaining collectors except for that collector have the shape of collector 70 shown in FIG. 4 without the bottom (see first collector $\mathbf{30}_1$ in FIG. 3).

Carbon nanotube layer 71 can be formed by synthesizing and growing a carbon nanotube from a carbon material over a required area on the surface of collector 70 using a known CVD (Chemical Vapor Deposition) method, an arc discharge method, or an electrolytic plating method.

Since the carbon nanotube is comprised of a large number of elongated structures with acute tips, which are combined with one another in a complicate manner, the carbon nanotube is thought to highly effectively collect electrons which collide therewith, i.e., exhibit a small value of the secondary electron emission coefficient. For example, according to a report by Lei Huang, S P Lau, H Y Yang, S F Yu ("Local measurement of secondary electron emission from ZnO-coated carbon" INSTITUTE OF PHYSICS PUBLISHING, Nanotechnology 17, 2006, pp. 1564-1567), it has been shown that the secondary electron emission coefficient $\sigma_{max}$ of the carbon nanotube presents a value of one or less, which is understood to be equivalent to or smaller than that of graphite.

Accordingly, carbon nanotube layer 71 formed on the surface of collector 70 restrains the secondary electron emission which is caused by the collisions of electrons emitted from the electron gun with collector 70. This results in a reduction in a helix current which is generated by the secondary electrons which are emitted from collector 70 through secondary electron emission to return to a helix (see FIG. 1), and this helix current flows from the helix to a ground potential. Consequently, the traveling wave tube is improved in efficiency, and the helix is prevented from being damaged due to a current flowing through the helix.

Also, carbon nanotube is free from lattice defects in end regions, as observed in graphite, because carbon atoms are bonded with one another in a circular shape, so that carbon atoms in the end regions will not be bonded with oxygen atoms, hydrogen atoms, or the like. Accordingly, carbon nanotube layer 71 will not easily peel off even if it is heated in a brazing operation or the like in an assembly process of the traveling wave tube. Further, since the carbon nanotube is comprised of a large number of elongated structures with acute tips, which are combined with one another in a complicate manner as described above, the carbon nanotube is resistant to peeling due to expansion and contraction of the base metal, even if there is a difference in thermal expansion coefficient between the base metal and the carbon nanotube.

Notably, the carbon nanotube is known to provide a hydrogen occlusion property to capture hydrogen with the van der Waals force. Thus, when a collector assembly comprised of collectors 70 of this embodiment is formed by brazing or the like in a hydrogen containing atmosphere, and a traveling wave tube is manufactured using the collector assembly, hydrogens captured in carbon nanotube layers 71 can be emitted to exacerbate the degree of vacuum within the enclosure of the traveling wave tube.

Accordingly, when manufacturing a traveling wave tube comprising collector 70 of this embodiment, a collector assembly is preferably formed in a vacuum. When the collector assembly is formed in a hydrogen containing atmosphere, the collector assembly after formation may be treated at high temperatures to desorb hydrogen captured in carbon nanotube layer 71 through thermal vibrations of atoms. In this regard, the collector assembly refers to a structure which has been previously assembled by brazing or the like such that one or a plurality of collectors, lead wires, insulating ceramic and the like can be disposed within the enclosure of the traveling wave tube.

According to this embodiment, carbon nanotube layer 71 is formed over a required area on the surface of collector 70 made of molybdenum, copper, or a composite material comprised of molybdenum and copper, collector 70 can be provided to have a small secondary electron emission coefficient and a surface layer hard to peel off. Also, when the collector of this embodiment is employed in an electron tube such as the traveling wave tube shown in FIG. 1, the helix current can be reduced, thus improving the efficiency of the electron tube, and preventing damage to the helix due to the helix current.

While the invention has been particularly shown and described with reference to exemplary embodiments thereof, the invention is not limited to these embodiments. It will be understood by those ordinarily skilled in the art that various changes in form and details may be made therein without departing from the spirit and scope of the present invention as defined by the claims.

The invention claimed is:

1. A collector included in an electron tube, comprising:

a carbon nanotube that is formed over a required area on a surface thereof and that reduces a secondary electron emission due to collisions of electron beams, wherein said required area is an area for capturing an electron beam emitted from an electron gun included in said electron tube.

2. An electron tube comprising the collector according to claim 1.

3. The collector according to claim 1, wherein:

said required area extends over the entirety of an inner surface of said collector.

* * * * *